US006879229B2

(12) United States Patent
Tanaka et al.

(10) Patent No.: US 6,879,229 B2
(45) Date of Patent: Apr. 12, 2005

(54) ELECTROMAGNETIC RELAY

(75) Inventors: Hiroyasu Tanaka, Yamaga (JP); Hironori Sanada, Tamana (JP); Hiroaki Yamasaki, Kumamoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/843,212

(22) Filed: May 11, 2004

(65) Prior Publication Data

US 2004/0246080 A1 Dec. 9, 2004

(30) Foreign Application Priority Data

May 12, 2003 (JP) ..... P2003-133039

(51) Int. Cl.[7] ..... H01H 67/02
(52) U.S. Cl. ..... 335/128; 335/84
(58) Field of Search ..... 335/78–86, 124, 335/128–131; 336/192, 198

(56) References Cited

U.S. PATENT DOCUMENTS 5,790,004 A * 8/1998 Matsuoka et al. ..... 335/78
5,990,770 A * 11/1999 Doneghue ..... 335/78
6,545,575 B1 * 4/2003 Hirabayashi et al. ..... 335/78

OTHER PUBLICATIONS

Patent Abstracts of Japan, publication No. 2000–213316; publication date Aug. 2, 2000, 1 page.

* cited by examiner

*Primary Examiner*—Lincoln Donovan
(74) *Attorney, Agent, or Firm*—Osha & May L.L.P.

(57) ABSTRACT

The invention provides an electromagnetic relay excellent in insulating property and high in opening and closing characteristics and productivity.

Therefore, a pair of pedestal portions for coil terminals are arranged in the outer circumferential edge portion of the lower flange portion of a spool. A coil drawing-out groove continuously connected to the upper face of the above pedestal portion for a coil terminal is formed along the outer circumferential edge portion of the above lower flange portion. A storing concave portion able to store a shading coil attached to a magnetic pole portion of an iron core projected from a central hole of the above spool is formed on the lower face of the above lower flange portion.

1 Claim, 6 Drawing Sheets

ELECTROMAGNETIC RELAY

BACKGROUND OF THE INVENTION

1. Field of the Invention

The present invention relates to an electromagnetic relay, particularly, an electromagnetic relay for high voltage having a shading coil.

2. Description of the Related Art

There is conventionally a structure in which the height size of a device is limited from the request of making the device compact as the electromagnetic relay (e.g., see patent literature 1).

[Patent literature 1]

JP-A-11-16472

Namely, in this electromagnetic relay, an electromagnet block rises on one side of the upper face of abase, and a contact mechanism is arranged on the other side of this base upper face. A movable iron piece is rotated on the basis of magnetizing and demagnetizing forces of the above electromagnet block, and the contact mechanism is operated through a card.

However, when the shading coil was intended to be mounted to a magnetic pole portion of an iron core of the above electromagnetic relay, it was inevitable to raise the height size of the entire electromagnet device. On the other hand, when the height size was limited from the request of the compactness of the device, it was necessary to correspondingly shorten the drum portion of a spool by the height size of the shading coil. As this result, the winding number of the coil able to be wound around the above drum portion is reduced so that no predetermined desirable driving force is obtained. Accordingly, opening and closing characteristics are reduced and an adjustable allowance range is narrowed as the opening and closing characteristics are reduced. Therefore, problems exist in that high accuracy of parts and assembly precision are required and productivity is reduced.

Further, when the above electromagnetic relay is intended to cope with the high voltage, it is necessary to secure a predetermined insulating distance between a drawing start portion of the coil bound and drawn out of a coil terminal and a winding termination portion of the coil completely wound. Therefore, the drawing start portion of the coil is drawn out of a coil drawing-out groove formed along the outer circumferential edge portion of a flange portion. However, when the coil drawing-out groove is intended to be formed in the above flange portion, the thickness of the flange portion is increased and the entire height size is increased. Accordingly, when the height size of the electromagnetic relay is limited, it is necessary to shorten the spool and problems similar to those in the above case are caused.

SUMMARY OF THE INVENTION

In consideration of the above problems, an object of the present invention is to provide an electromagnetic relay for high voltage excellent in insulating property and high in opening and closing characteristics and productivity.

To achieve the above object, the present invention resides in an electromagnetic relay in which an electromagnet block is constructed such that a coil is wound around the drum portion of a spool having upper and lower flange portions in upper and lower end portions thereof respectively, and an iron core is inserted into a central hole of the drum portion, and its projected upper end portion is fixed to a yoke and the projected lower end portion is set to a magnetic pole portion; the electromagnet block rises on one side of the upper face of a base; and a contact mechanism is arranged on the other side of the base upper face and is operated by a movable iron piece rotated on the basis of magnetizing and demagnetizing forces of the electromagnet block; wherein a pair of pedestal portions for coil terminals are arranged in the outer circumferential edge portion of the lower flange portion, and a coil drawing-out groove continuously connected to the upper face of the pedestal portion for a coil terminal is formed along the outer circumferential edge portion of the lower flange portion, and a storing concave portion able to store a shading coil attached to a magnetic pole portion of the iron core projected from the central hole of the spool is formed on the lower face of the lower flange portion.

In accordance with the present invention, the shading coil is arranged in the storing concave portion arranged on the lower face of the lower flange portion, and the coil drawing-out groove is arranged in the outer circumferential edge portion of the above lower flange portion. Accordingly, since the coil drawing-out groove is located on the side of the shading coil stored in the above storing concave portion, it is possible to restrain an increase in height size in the vertical direction elongated in the conventional example. Therefore, the reduction in length size in the drum portion of the spool can be also restrained in the electromagnetic relay limited in the height size. Accordingly, while insulating characteristics are secured, opening and closing characteristics can be maintained without making the electromagnetic relay large-sized. Further, there is an effect in that the reduction in productivity can be prevented.

DESCRIPTION OF THE PREFERRED EMBODIMENTS

The embodiment modes of the present invention will be explained in accordance with the accompanying drawings of FIGS. 1 to 6.

Figure 1:
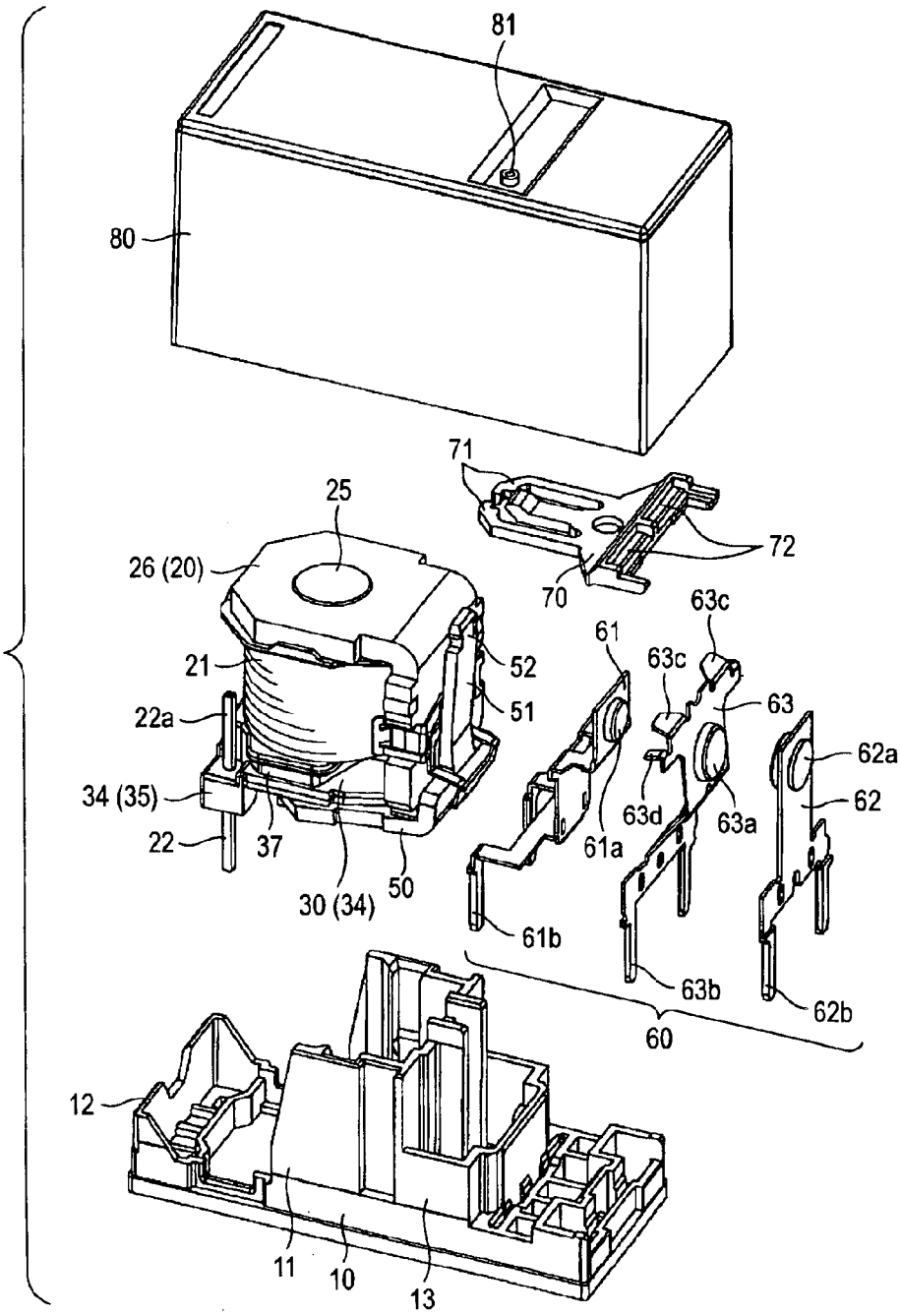
FIG. 1 is an exploded perspective view showing an embodiment mode of an electromagnetic relay in the present invention.
Figure 2A:
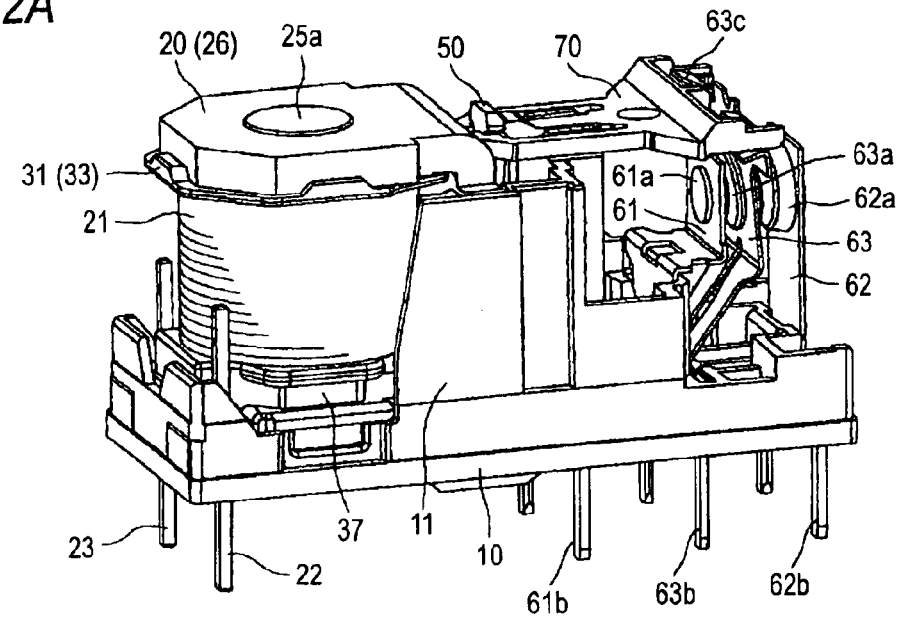
FIG. 2A is a perspective view showing an intermediate state of assembly of the electromagnetic relay shown in FIG. 1.
Figure 2B:
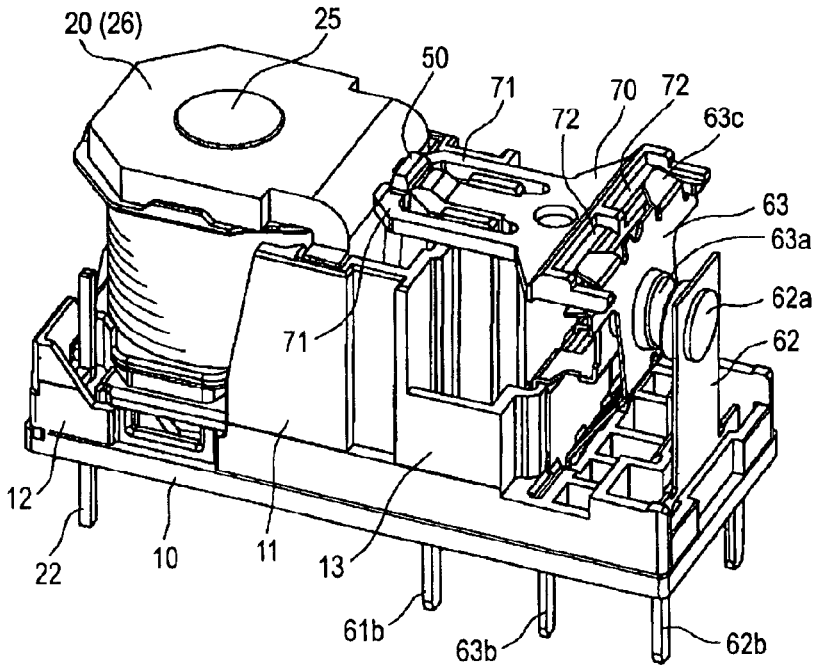
FIG. 2B is a perspective view in which the intermediate state of assembly of the electromagnetic relay shown in FIG. 1 is seen from a different angle.

As shown in FIG. 1, the embodiment mode of an electromagnetic relay in the present invention is schematically constructed by a base 10, an electromagnet block 20, a contact mechanism 60, a card 70 and a cover 80.

In the base 10, a first insulating wall 11 having a substantially square bracket-shape in a planar view is projected at the center of the upper face of the base 10. Further, a second insulating wall 13 is projected behind the first insulating wall 11. On the other hand, a seal wall 12 for preventing the invasion of a sealant is projected along one side edge portion of the upper face of the base 10. The electromagnet block 20 is arranged between the first insulating wall 11 and the second insulating wall 13. On the other hand, the contact mechanism 60 is arranged behind the first insulating wall 11.

Figure 3:
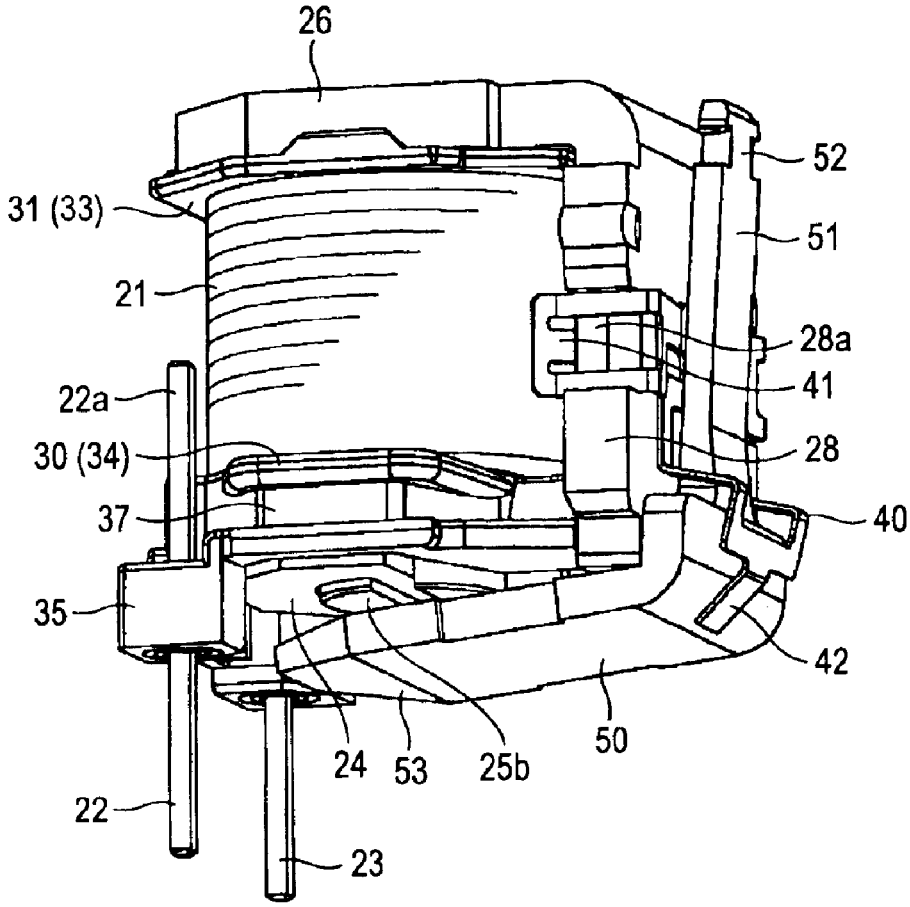
FIG. 3 is a perspective view of an electromagnet block shown in FIG. 1.
Figure 4:
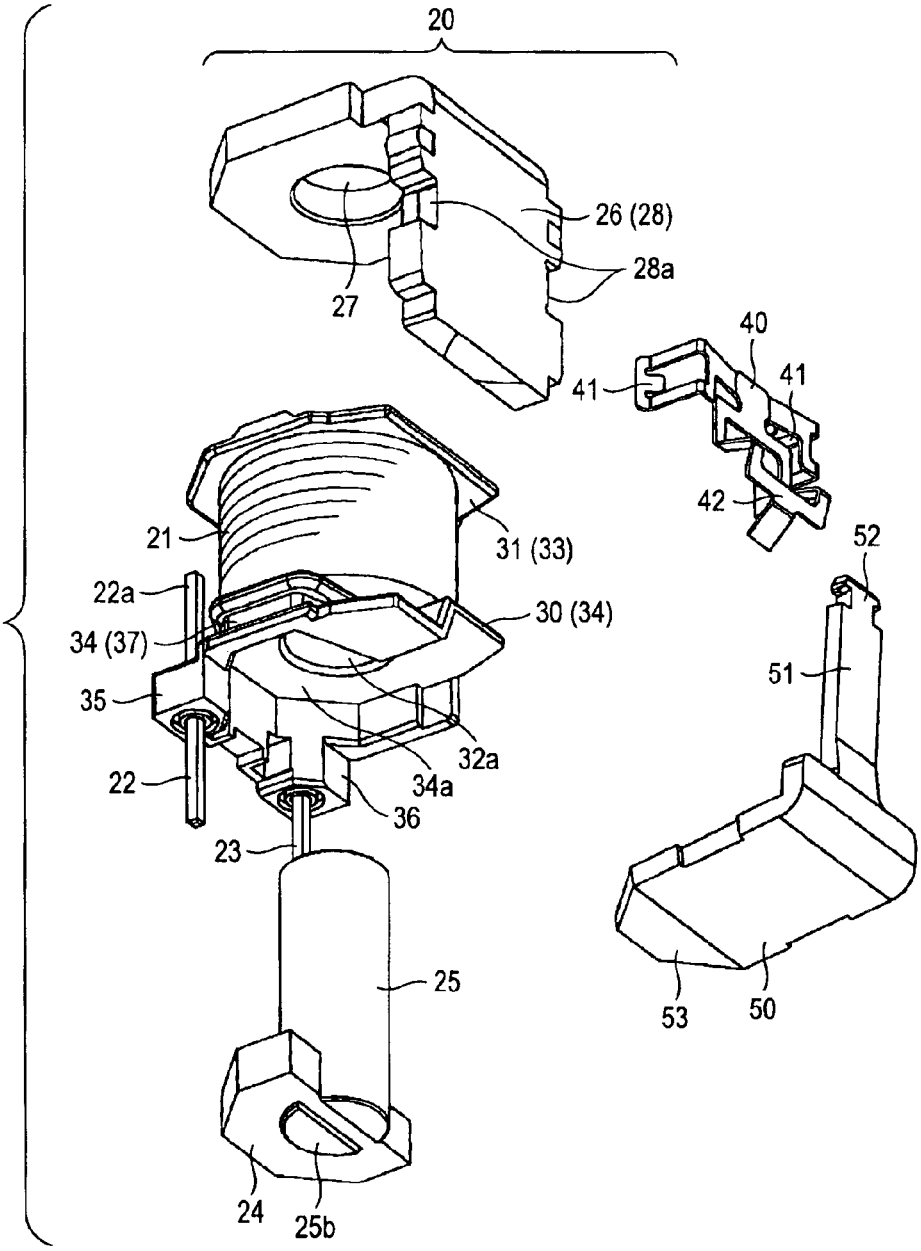
FIG. 4 is an exploded perspective view of the electromagnet block shown in FIG. 3.
Figure 5C:
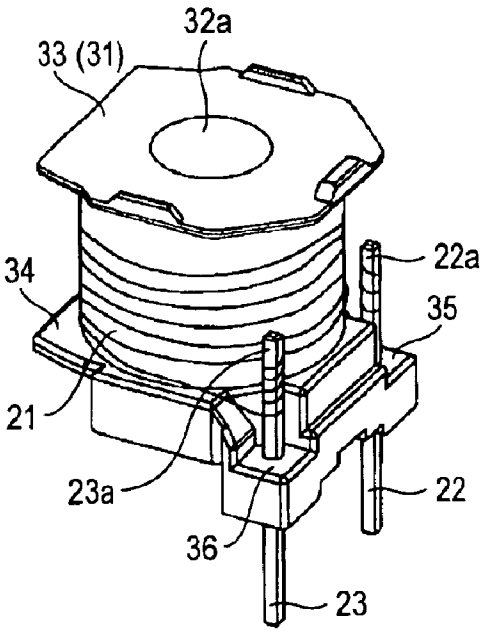
FIG. 5 is a perspective view showing a manufacturing process of an electromagnet device shown in FIG. 4.
Figure 5B:
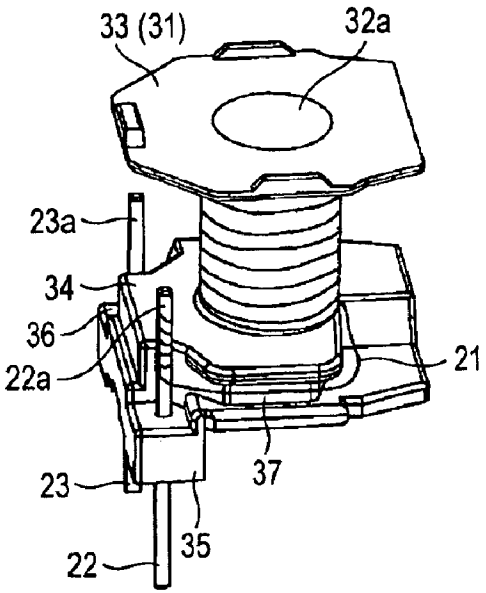
Figure 5A:
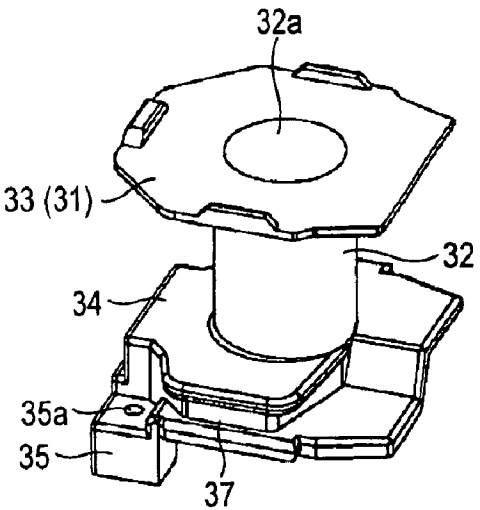
Figure 6B:
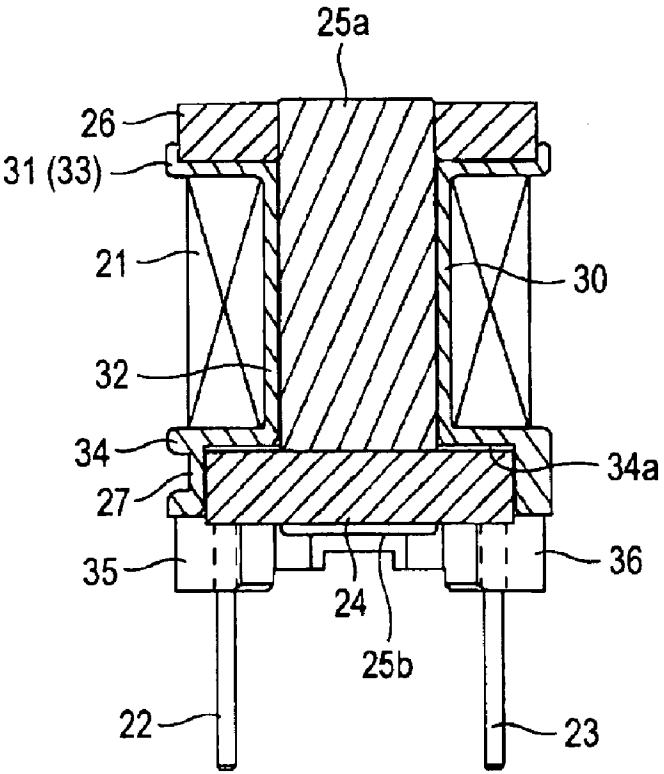
FIG. 6B is a cross-sectional view taken along line VIB—VIB of FIG. 6A.

As shown in FIGS. 3 and 4, in the above electromagnet block 20, a movable iron piece 50 is rotatably hinged and supported by an electromagnet device 30 through a hinge spring 40. In the electromagnet device 30, a coil 21 is wound around a spool 31 having upper and lower flange portions 33, 34 at both the ends of a drum portion 32 (FIG. 5A). A storing concave portion 34*a* is formed on the lower face of the lower flange portion 34 of the spool 31. Further, pedestal portions 35, 36 for coil terminals are integrally molded in positions lowered by one stage in the outer circumferential edge portion of the lower flange portion 34. Further, in the lower flange portion 34, a coil drawing-out groove 37 continuously connected to the upper face of the pedestal portion 35 for a coil terminal is formed along the outer circumferential edge portion of the lower flange portion 34. The storing concave portion 34*a* and the coil drawing-out groove 37 are approximately located at the same height (FIG. 6B).

Accordingly, after coil terminals 22, 23 are respectively press-fitted into unillustrated terminal holes 35*a*, 36*a* of the pedestal portions 35, 36 for coil terminals (FIG. 5B), their binding portions 22*a*, 23*a* are bent outward. After one end of the coil 21 is bound in the binding portion 22*a* of the coil terminal 22, the coil 21 is drawn out along the coil drawing-out groove 37 and is wound around the drum portion 32. In FIG. 5B, for convenience of the explanation, the coil terminals 22, 23 straightly extended are illustrated. Further, after a winding termination portion of the coil 21 is bound in the binding portion 23*a* of the coil terminal 23 and is soldered, the above binding portions 22*a*, 23*a* are perpendicularly bent and raised (FIG. 5C).

Next, as shown in FIG. 4, an iron core 25 caulking and fixing a shading coil 24 to one end portion thereof is inserted into a central hole 32*a* of the spool 31, and a projected upper end portion 25*a* is fitted to a caulking hole 27 of a yoke 26 formed in a substantially L-shape and is caulked and fixed. Thus, the shading coil 24 is positioned in the storing concave portion 34*a* and the lower end portion of the iron core 25 becomes a magnetic pole portion 25*b* (FIG. 6) so that the electromagnet device 30 is completed.

The above hinge spring 40 is formed by punching and press-working a thin plate spring material. Arm portions 41, 41 are extended from both side edge portions of the hinge spring 40. On the other hand, a frame-shaped leg portion 42 is extended from the lower edge portion of the hinge spring 40 and is bent.

Figure 6A:
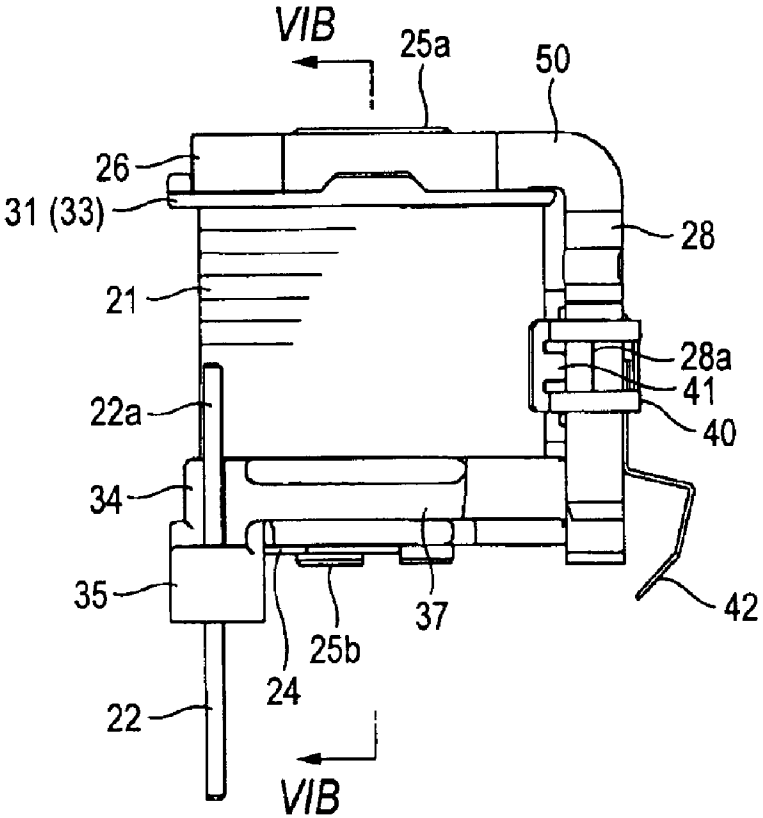
FIG. 6A is a front view showing a state in which a yoke is attached to the electromagnet device shown in FIG. 5.

Arm portions 41*a*, 41*a* of the hinge spring 40 are respectively engaged and fixed to notch portions 28*a*, 28*a* formed in both the side edge portions of a perpendicular portion 28 of the yoke 26 (FIG. 6A). Next, a perpendicular portion 51 of a movable iron piece 50 is inserted into the bent frame-shaped leg portion 42 of the hinge spring 40, and the movable iron piece 50 is rotatably positioned in the lower end edge portion of the perpendicular portion 28 of the yoke 26 (FIG. 3). As this result, a horizontal end portion 53 of the movable iron piece 50 is opposed to the magnetic pole portion 25*a* of the iron core 25 so as to approach the magnetic pole portion 25*a* and be separated from the magnetic pole portion 25*a*. The coil terminals 22, 23 are projected from the lower face of the base 10 by assembling the above electromagnet block 20 between the first insulating wall 11 and the seal portion 12 of the base 10.

As shown in FIG. 1, in the contact mechanism 60, a bent movable contact piece 63 is arranged between a bent normally closed fixing contact piece 61 and a straight normally opened fixing contact piece 62. A movable contact 63*a* is opposed to a normally closed fixing contact 61*a* and a normally opened fixing contact 62*a* so as to alternately approach these contacts and be separated from these contacts.

The normally closed fixing contact piece 61, the normally opened fixing contact piece 62 and the movable contact piece 63 are sequentially press-fitted and assembled into the base 10. In this embodiment mode, high insulating characteristics can be shown since the electromagnet block 20 and the contact mechanism 60 are partitioned by the first insulating wall 11. In particular, higher insulating characteristics are obtained since the base portion of the normally closed fixing contact piece 61 is located between the first insulating wall 11 and the second insulating wall 12.

The card 70 is a resin molded product having a pair of elastic arm portions 71, 71 on one end side thereof and also having a wide engagement receiving portion 72 on the other end side. The elastic arm portion 71 is engaged with a slender neck portion 52 arranged in the perpendicular portion 51 of the above movable iron piece 50. On the other hand, a pair of upper and lower claw portions 63*c*, 63*d* (FIG. 1) arranged in the upper end portion of the movable contact piece 63 are engaged with the engagement receiving portion 72. Thus, the electromagnet block 20 and the contact mechanism 60 are connected to each other.

The cover 80 has a box shape able to be fitted to the base 10, and a degassing hole 81 is formed on the ceiling face. Accordingly, the electromagnet block 20 and the contact mechanism 60 are assembled into the base 10 and are connected to each other by the card 70. Thereafter, the cover 80 is fitted to the base 10 and is sealed. Thereafter, the internal gas is degassed from the degassing hole 81 and heat sealing is performed so that the assembly work is completed.

The operation of the electromagnetic relay having the construction will next be explained.

When no voltage is applied to the coil 21, the card 70 is energized on the electromagnet block 20 side by the spring force of the movable contact piece 63, and the horizontal end portion 53 (FIG. 4) of the movable iron piece 50 is opened and separated from the magnetic pole portion 25*b* of the iron core 25. Therefore, the movable contact 63*a* comes in contact with the normally closed fixing contact 61*a*. In contrast to this, the movable contact 63*a* is opened and separated from the normally opened fixing contact 62*a*. When the voltage is applied to the coil 21 and the coil 21 is magnetized, the magnetic pole portion 25*b* of the iron core 25 attracts the horizontal end portion 53 of the movable iron piece 50. Accordingly, the movable iron piece 50 is rotated against the spring force of the movable contact piece 63 with the lower end edge portion of the perpendicular portion 28 of the yoke 26 as a fulcrum, and pushes the card 70. Therefore, the movable contact piece 63 is elastically deformed through the card 70 and the movable contact 63*a* is opened and separated from the normally closed fixing contact 61*a* and comes in contact with the normally opened fixing contact 62*a*. Thereafter, the horizontal end portion 53 of the movable iron piece 50 is adsorbed to the magnetic pole portion 25*b* of the iron core 25.

When the electric supply to the coil 21 is next interrupted, the card 70 is pushed back by the spring force of the movable contact piece 63, and the horizontal end portion 53 of the movable iron piece 50 is opened and separated from the magnetic pole portion 25*b* of the iron core 25. Therefore, the movable contact 63*a* is switched from the normally opened fixing contact 62*a* to the normally closed fixing contact 61*a* and is returned to the original state.

In accordance with the present invention, the shading coil is arranged in the storing concave portion arranged on the lower face of the lower flange portion, and the coil drawing-out groove is arranged in the outer circumferential edge portion of the above lower flange portion. Accordingly, since the coil drawing-out groove is located on the side of the shading coil stored to the above storing concave portion, it is possible to restrain an increase in height size in the vertical direction elongated in the conventional example. Therefore, the reduction in length size in the drum portion of the spool can be also restrained in the electromagnetic relay limited in the height size. Accordingly, while insulating characteristics are secured, opening and closing characteristics can be maintained without making the electromagnetic relay large-sized. Further, there is an effect in that the reduction in productivity can be prevented.

What is claimed is:

1. An electromagnetic relay in which an electromagnet block is constructed such that a coil is wound around the drum portion of a spool having upper and lower flange portions in upper and lower end portions thereof respectively, and an iron core is inserted into a central hole of said drum portion, and its projected upper end portion is fixed to a yoke and the projected lower end portion is set to a magnetic pole portion; the electromagnet block rises on one side of the upper face of a base; and a contact mechanism is arranged on the other side of said base upper face and is operated by a movable iron piece rotated on the basis of magnetizing and demagnetizing forces of said electromagnet block;

wherein a pair of pedestal portions for coil terminals are arranged in the outer circumferential edge portion of said lower flange portion, a coil drawing-out groove continuously connected to the upper face of said pedestal portion for a coil terminal is formed along the outer circumferential edge portion of said lower flange portion, and a storing concave portion able to store a shading coil attached to a magnetic pole portion of the iron core projected from the central hole of said spool is formed on the lower face of said lower flange portion.

* * * * *